United States Patent [19]

Nidelkoff

[11] 4,132,020

[45] Jan. 2, 1979

[54] SIGN STRUCTURE

[75] Inventor: James G. Nidelkoff, White Bear Lake, Minn.

[73] Assignee: Minnesota Mining and Manufacturing Company, St. Paul, Minn.

[21] Appl. No.: 756,092

[22] Filed: Jan. 3, 1977

[51] Int. Cl.[2] ..... G09F 7/08

[52] U.S. Cl. ..... 40/606; 40/491; 40/596; 40/605; 40/618

[58] Field of Search ..... 40/140, 142 R, 13, 14, 40/65, 102, 375, 490, 525, 530, 618, 620, 606; 248/486

[56] References Cited

U.S. PATENT DOCUMENTS

| | | | |
|---|---|---|---|
| 2,092,508 | 9/1937 | Hammar | 40/142 R |
| 2,230,873 | 2/1941 | Wagner et al. | 40/140 |
| 3,059,363 | 10/1962 | Mack | 40/140 |
| 3,310,901 | 3/1967 | Sarkisian | 40/13 |
| 3,373,517 | 3/1968 | Halperin | 40/65 |

*Primary Examiner*—John F. Pitrelli
*Assistant Examiner*—G. Lee Skillington
*Attorney, Agent, or Firm*—Cruzan Alexander; Donald M. Sell; Robert W. Burns

[57] ABSTRACT

A sign structure having a copy board which is movable across the face of the structure and which releasably mounts display symbols such as numeric and alphabetic charactrers. The copy board comprises a frame which is mounted to the sign structure via rollers and may be positioned at will along the length of the sign structure adjacent to, overlapping, or removed from a vignette, etc., displayed on the sign face. Retainer bars extend between opposite sides of the copy board frame and are adapted for releasably mounting symbols by engaging slots formed in the symbols. Great flexibility is provided in positioning the symbols, for the copy board frame can be positioned at will along the sign, the retainer bars can be positioned substantially anywhere along the copy board frame in the direction perpendicular to their length, and the symbols can be positioned at will along the length of the retainer bars.

4 Claims, 8 Drawing Figures

SIGN STRUCTURE

BACKGROUND OF THE INVENTION

1. Field of the Invention

This invention relates to changeable copy board letters and to a copy board which is freely movable over a sign face to preclude interference with a background display.

2. Description of the Prior Art

It is known in the prior art to place changeable copy board letters, numerals, vignettes, and other indicia over a coordinated background, such as a sign face vignette. The present state of the art is that rails are permanently mounted over the background to receive changeable letters, etc. Unfortunately, such rails typically obscure and perhaps detract from the appearance of the background.

SUMMARY OF THE INVENTION

The invention relates to a sign structure comprising a first frame, suitable for mounting a sign face, and a second frame which comprises pairs of spaced, parallel frame members and is mounted to the first frame for movement across the first frame. Retainer-bar structures for releasably mounting slotted display symbols (alphabetic or numeric characters, etc.) are adapted for mounting at various positions along the length of one pair parallel, second frame members. Each retainer-bar structure comprises a pair of elongated bar-like members which extend between the pair of second frame members, are pivotally connected at one lengthwise edge, and are biased apart so that second, flanged lengthwise edges forceably engage the slotted display symbol.

BRIEF DESCRIPTION OF THE DRAWINGS

The invention will be more fully described in reference to the accompanying drawing, wherein.

DETAILED DESCRIPTION OF THE PREFERRED EMBODIMENT

Figure 1:
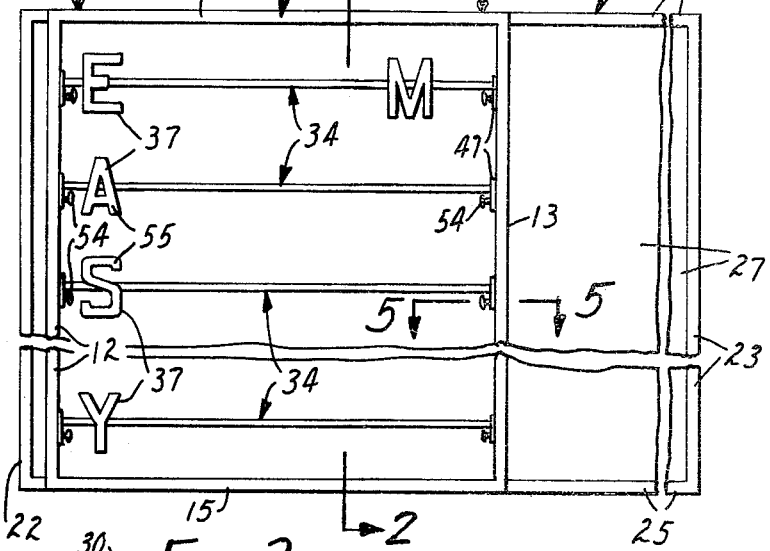
FIG. 1 is a front elevational view of a sign structure embodying the principles of the present invention.

Referring to FIG. 1, there is shown a sign structure 10 supporting a movable copy board 11 which is constructed according to the principles of the present invention. The exemplary copy board 11 is designed to mount informational symbols and, in turn, is mounted for horizontal movement along the sign structure. As explained below, the movable copy board 11 may be positioned at any desired location along the length of the sign structure 10 and the position of the copy board may be changed without requiring permanent rails, etc., that obstruct messages or vignettes positioned elsewhere on the sign structure. In addition, the horizontal and vertical positions of the symbols mounted on the copy board 11 may be varied at will.

The copy board 11 includes a frame having parallel side rails 12 and 13 and parallel top and bottom rails 14 and 15. The sign structure 10 comprises a second, larger rectangular frame having parallel side channels 22 and 23 and parallel top and bottom channels 24 and 25. As will be readily understood by those skilled in the art, messages, vignettes, etc. may be displayed on the sign structure 10 in various ways, as by attachment to a sign face 27 which is affixed to the back of the channels.

The top channel 24 and the bottom channel 25 are adapted to movably mount the copy board 11. Referring to the FIG. 2 cross-sectional view of the sign structure 10 and copy board 11, the top and bottom channels 24 and 25 form enclosed tracks for wheels or rollers 28—28. Each roller is rotatably mounted on an axle or shaft 29 which extends through a longitudinal slot 31 formed in the front side of the channel. Each shaft 29 is fixably mounted to the top or bottom rail 14 or 15 of the copy board 11, as by a nut 32 threaded on a reduced-diameter portion 33 of the shaft. For stability, at least two rollers 28—28 are mounted to each of the top rail 14 and the bottom rail 15, typically near the opposite ends of each rail. With this arrangement, the copy board 11 may be quickly and easily moved to any position along the horizontal length of the sign structure 10. Thus, the copy board may be positioned adjacent to, removed from, or overlapping a message, vignette, etc., on the sign face 27. The copy board can be retained in position by pins 30—30 inserted into apertures spaced along the top channel 24 adjacent one or more of the rollers.

Referring again to FIG. 1, the copy board frame is adapted to mount one or more retainer-bar assemblies 34—34. The bar assemblies extend between the copy board side rails 12 and 13 and, as discussed below, can be mounted at any of several mounting positions which are spaced vertically along the side rails. The bar assemblies 34—34 are also adapted for quick mounting and removal of symbols, characters, etc., such as the three-dimensional letters 37—37 shown in FIG. 1.

Figure 3:
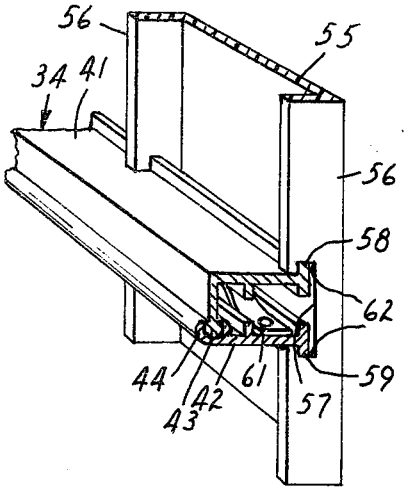
FIG. 3 is a fragmentary rear perspective view of the sign structure of FIG. 1, showing the arrangement for releasably mounting a slotted, three-dimensional character.
Figure 2:
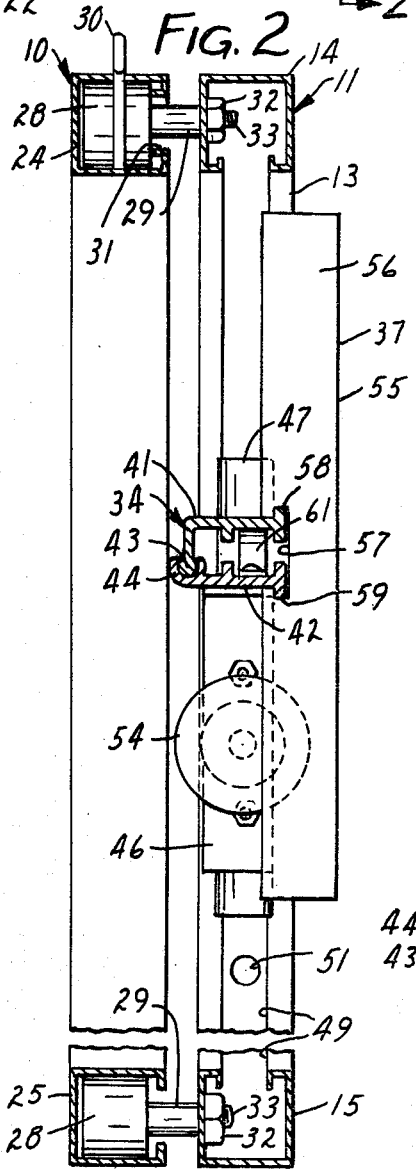
FIG. 2 is a vertical sectional view of the sign structure of FIG. 1, taking along the lines 2—2 in FIG. 1.

Referring to FIGS. 2 and 3, the letter retainer-bar assemblies 34—34 comprise elongated, hinged, bar-like top and bottom wing members 41 and 42. In the exemplary embodiment, each top wing 41 is L-shaped in transverse cross section and has a circular or ball-shaped first end 43 received by a socket 44 at the corresponding first end of the bottom wing 42 to form a ball and socket hinge.

Figure 4:
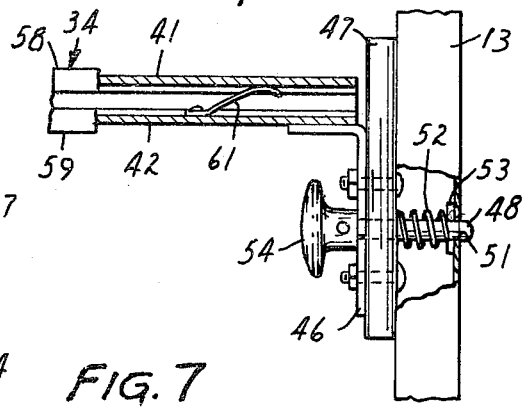
FIG. 4 is an enlarged, fragmentary view of FIG. 1, showing one end of a retainer-bar assembly and the arrangement for mounting the retainer bar assembly to the copy board frame.

Referring now to FIG. 4, L-shaped brackets 46—46 are affixed at one arm thereof to the opposite ends of the bottom wing 42 (only one end and one bracket are shown). The other arm of each bracket 46 mounts a cylindrical spacer 47 and a spring-loaded pin 48 which extends through the bracket 46 and the spacer 47.

Each of the side rails 12 and 13 has a longitudinal (vertical) slot 49 formed in the inside wall (see slotted rail 13 in FIG. 2) and has apertures 51—51 spaced vertically along the outside wall for receiving the pins 48—48. The elongated spacers 47—47 fit in the slots 49—49 and thereby prevent the retainer-bar assembly 34 from pivoting when it is attached to the side rails, and facilitate sliding the retainer-bar assembly between vertical positions.

Figure 5:
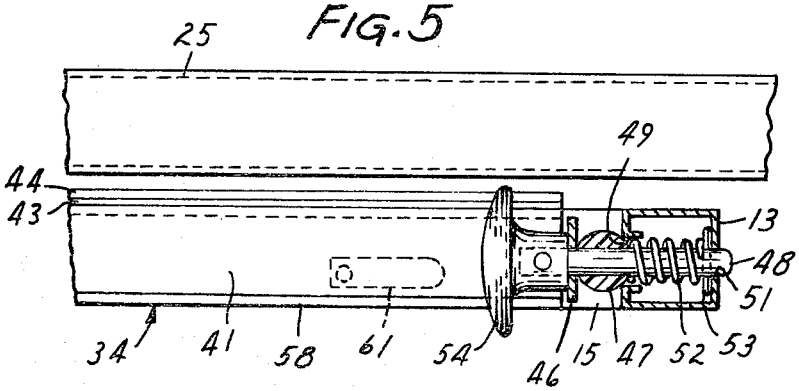
FIG. 5 is a horizontal sectional view of the sign structure of FIG. 1, taken along the lines 5—5 in FIG. 1 and showing additional details of the arrangement for mounting the retainer-bar assembly.

As shown most clearly in FIGS. 4 and 5, the retainer-bar assembly 34 is releasably attached to the side rail by one of the pins 48—48. Each of the pins 48—48 carries a spring 52, which is retained between the spacer 47 and a cotter pin 53 attached to the outer end of the pin 48. The spring 52 biases the pin 48 outwardly for insertion into one of the rail apertures 51—51 to retain the retainer-bar assembly 34 in position. A knob 54 is attached to the inner end of each pin and is used to pull the pins inwardly (out of the apertures 51—51) for removing or moving the retainer-bar assembly.

Figure 6:
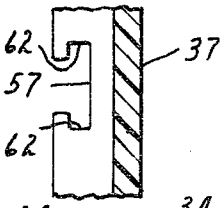
FIG. 6 is an enlarged view of the slotted region of the three-dimensional character shown in FIGS. 2 and 3.

The mounting of characters or other symbols to the retainer-bar assemblies 34—34 is perhaps best illustrated by the arrangement for mounting the letters 37—37 shown in FIGS. 2 and 3. The letters 37—37 typically comprise a face 55 which defines the shape of the particular letter and transverse flanges 56—56 which extend rearwardly from the face 55. The flanges 56—56 have substantially T-shaped cutouts 57—57 (see also FIG. 6) at the rear edge thereof for mounting the letter to the retainer bar-assembly 34.

Figure 7:
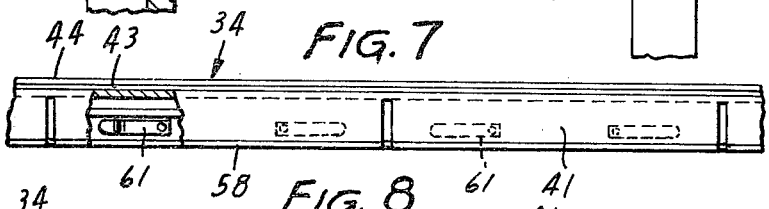
FIGS. 7 and 8 are, respectively plan and front elevational views of a section of the retainer-bar assembly.
Figure 8:
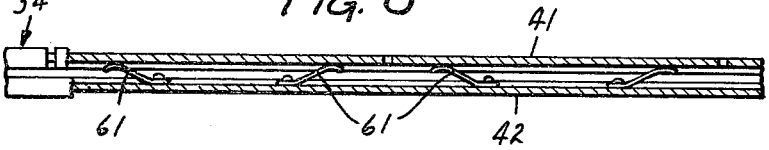

Referring to the top and front views of the retainer-bar assembly 34 shown in FIGS. 7 and 8, respectively, flat springs 61—61 are mounted between the top and bottom wings 41 and 42 to bias the wings away from one another. Referring to FIGS. 2 and 3, to mount a letter 37 to the retainer-bar assembly, the top and bottom wings are pressed together against the biasing action of the springs to allow the letter slot 57 or slots to be slipped over transverse flanges 58 and 59 formed in second ends of the top wing 41 and the bottom wing 42, respectively, and onto the retainer bar. When the wings are released, the springs 61—61 urge the wings away from one another and into arms 62—62 (see also FIG. 6) of the slot 57 to secure flanges 58 and 59 in the slot arms 62—62 and thus mount the letter on the retainer-bar assembly.

The retainer-bar assembly 34 provides versatility in that the letters, etc. can be quickly changed or moved. Also, the retainer-bar assembly securely mounts the letters so that the copy board 11 may be used in signs on moving vehicles or in other applications which require a secure, wind-resistant mounting.

Preferably, as shown in FIG. 7, the top wing 41 comprises individual sections which are long enough to hold one (or several) letters. The use of relatively short upper wing sections permits adding, removing or changing individual letters without the risk of dislodging the other letters from the retainer-bar assembly 34.

Thus, there has been described a copy board having movable, changeable symbols. The copy board 11 is described as being mounted for horizontal movement along the top and bottom channels 24 and 25 of sign structure 10. The copy board can be mounted for movement in the vertical direction along the side channels 22 and 23, or in other directions along the top and bottom channels or the side channels dependent only upon the orientation of the channels. The retainer-bar assemblies 34—34 can, of course, be positioned vertically between the top and bottom channels 24 and 25 for movement between positions spaced along the top and bottom channels. The sign structure 10 and copy board 11 are not limited to the exemplary rectangular arrangement, for other arrangements, such as other polygons having opposed parallel sides, may be used.

The sign structure 10 may be in the form of a billboard, a theatre marquee, a display for vans or other vehicles, etc. Of course, where movement along a sign structure is unnecessary, the copy board 11 may be used by itself to provide the disclosed versatility of changeable and movable symbols. It should be noted that "symbol" is intended to include not only alphabetic and numeric characters, but also any type of physical object adaptable to the slot-bar assembly mounting arrangement.

Having described preferred and alternative embodiments of the invention, what is claimed is:

1. A sign structure adapted for releasably mounting at least one slotted display symbol having a frame comprising at least two pairs of spaced apart parallel elongated frame members and at least one retainer-bar structure adapted for mounting in various positions along the length of one of said pairs of frame members and extending between said frame members, said retainer-bar structure further comprising:

(a) first and second elongated bar-like members each having first and second opposite and lengthwise edges;

(b) said first bar-like member being of approximately L-shaped transverse cross section, the first lengthwise edge thereof forming a ball and socket connection with the first lengthwise edge of said second bar-like members;

(c) the second lengthwise edge of said first and second bar-like members having a flange extending transverse to the length of said member; and (d) at least a spring being mounted between said first and second bar-like members for biasing said members away from one another for forcibly engaging the flanges against the display symbol slot.

2. A sign structure for releaseably mounting slotted display symbols, comprising:

(a) a first frame;

(b) a second frame mounted for movement across the first frame and being of smaller dimension than said first frame in the direction of movement, said second frame comprising at least two pairs of spaced apart parallel elongated frame members, one of said pairs of frame members having a series of apertures spaced along each of the members;

(c) a plurality of parallel elongated retainer bars mounted between the pair of frame members having said apertures, the opposing ends of each of said retainer bars having:

(i) spacer means integral with each end of the retainer bars for slidable movement along the pair of frames having said apertures, and (ii) spring loaded pin means mounted on said spacer means adapted to be moved with said bars into registry with said apertures and further adapted for engagement and disengagement with said apertures for permitting movement of said retainer bars when disengaged and securing said retainer bars to said pair of frame members when engaged with said apertures, the retainer bars further comprising top and bottom wing members, the top wing member being in L-shaped configuration and having a first edge thereof hinged to a first edge of the bottom wing member by ball and socket means, the wing members having free edges opposite said first edges each free edge having flange means adapted to fit in said slotted display symbols, and (iii) spring means disposed along said wing members proximate to said flange means to bias said flange means away from each other and against the display symbol slot.

3. The sign structure of claim 2 in which said spring means urge the first edges of said top and bottom wing members together at said ball and socket means.

4. The structure of claim 2 wherein said top wing member of said elongated retainer bars comprises individual movable sections for securing at least one of said slotted display symbols.

* * * * *